United States Patent [19]

Fogle

[11] 4,294,187

[45] Oct. 13, 1981

[54] APPLICATOR FOR DIRECT ROLL COATING

[75] Inventor: Ozzie Fogle, Orangeburg, S.C.

[73] Assignee: Champion International Corporation, Stamford, Conn.

[21] Appl. No.: 156,818

[22] Filed: Jun. 5, 1980

Related U.S. Application Data

[63] Continuation of Ser. No. 900,819, Apr. 27, 1978, abandoned.

[51] Int. Cl.[3] ..... B05C 1/00

[52] U.S. Cl. ..... 118/244; 29/131; 118/248; 118/264; 427/428; 427/429

[58] Field of Search ..... 29/130, 131, 110, 121.1, 29/121.3; 118/239, 244, 248, 252, 264; 427/428, 429

[56] References Cited

U.S. PATENT DOCUMENTS

| | | | |
|---|---|---|---|
| 1,903,038 | 3/1933 | Fujii | 29/131 |
| 2,565,036 | 8/1951 | Macdonald | 427/428 X |
| 2,602,174 | 7/1952 | Colangelo | 29/131 X |
| 2,662,269 | 12/1953 | Nash | 29/131 X |
| 2,741,014 | 4/1956 | Hubbard | 29/130 |
| 2,794,240 | 6/1957 | Allen | 29/131 |
| 3,467,009 | 9/1969 | Ross | 29/130 |
| 3,508,523 | 4/1970 | De Meerleer | 427/428 X |
| 3,587,153 | 6/1971 | Blickenderfer | 29/132 |
| 3,910,186 | 10/1975 | D'Amato et al. | 29/131 X |
| 3,926,701 | 12/1975 | Nishiwaki | 29/132 X |
| 4,051,277 | 9/1977 | Wilkinson et al. | 427/428 X |

*Primary Examiner*—Shrive P. Beck

*Attorney, Agent, or Firm*—Evelyn M. Sommer

[57] ABSTRACT

A paint applicator for direct roll coating of textured panels or sheet-like members comprises a core, a layer of fibrous web material disposed over the core, a protective plastic tube member disposed around the layer of fibrous web material, and a layer of woven material disposed over the protective tube member. The fibrous web allows for uniform application of the paint film due to its softness and ability to follow contoured surfaces. The protective tube member prevents paint from penetrating the fiber web. The woven material carries the paint on the roll applicator.

7 Claims, 4 Drawing Figures

APPLICATOR FOR DIRECT ROLL COATING

This is a continuation of application Ser. No. 900,819, filed Apr. 27, 1978, now abandoned.

There is also a problem with air pollution. A further technique used for coating the panels is coating the panel with a rubber or paint type roller. However, with this technique there is poor control of the paint film and inconsistency of results with some of the striations or grooves in the panel being left uncoated. This has been found to be especially true after a period of use when the paint dried on the outer surface of the roller, thus rendering the roller inflexible and unable to penetrate the striations and grooves of the panel.

Accordingly, it is an object of the subject invention to provide a paint applicator for direct roll coating of textured panel members which allows for the uniform application of the paint film.

It is another object of the subject invention to provide a paint applicator for coating textured panel members which is efficient and in which the paint applied is controlled so as to minimize loss of paint and air pollution.

It is a further object of the subject invention to provide an applicator for roll coating textured panel members as described above which is simple in construction and relatively inexpensive to manufacture.

SUMMARY OF THE INVENTION

In accordance with the above-stated objectives, the subject invention provides a paint applicator for direct roll coating of textured panels or sheet-like members which comprises a core member and a layer of fibrous web material disposed over the core. The fibrous material may be a synthetic or natural fiber which is preferably of a web construction held together by a binding adhesive. A protective tube member is disposed around the layer of fibrous web material, the tube being preferably a thin impervious plastic material such as polyethylene. A thin layer of woven material, such as woven sock material, is disposed over the protective tube member to complete the construction of the subject roll coater.

DETAILED DESCRIPTION OF THE PREFERRED EMBODIMENTS

Figure 1:
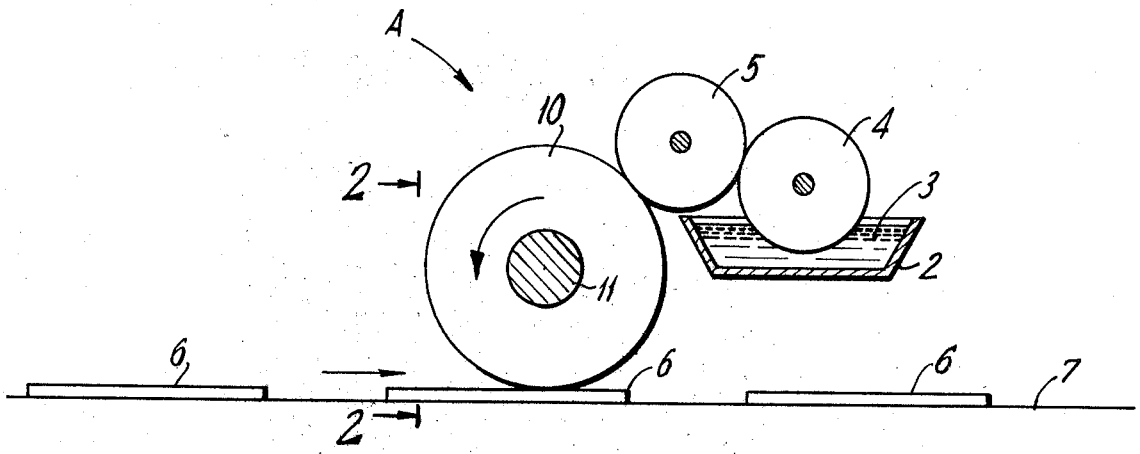
FIG. 1 is a front elevational schematic view, sectioned in part, illustrating the operation of the roll coater of the subject invention.

Referring to FIG. 1, there is illustrated a schematic drawing illustrating a continuous coating apparatus A employing the direct roll coating applicator of the subject invention, the applicator being designated generally by reference numeral 10. As illustrated in FIG. 1, the apparatus A includes a moving conveyor belt 7 which carries panel members 6 in succession into contact with roll coater 10. The apparatus A also includes a reservoir 2 which contains the coating material

3, and a pair of rollers 4 and 5, roller 4 being partially immersed in coating material 3. Typically, coating material 3 is a paint or dye. As rollers 4 and 5 rotate, they carry coating material 3 from reservoir 2 to the outer surface of roll coater 10. Roll coater 10 in turn rotates along shaft 11, continuously receives fresh coating material, and applies the coating to the panels 6 passing thereunder along belt 7. It will be appreciated that there are many methods of applying the coating material 3 to the outer surface of roll coater 10 besides that illustrated in FIG. 1, and that said illustration is in no way intended to limit the scope of the subject invention.

Figure 3:
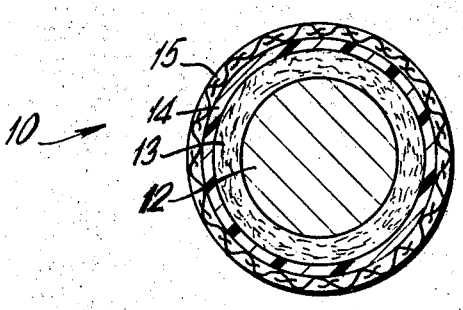
FIG. 3 is a cross-sectional view of the roll coater of the subject invention taken along lines 3—3 of FIG. 2.
Figure 4:
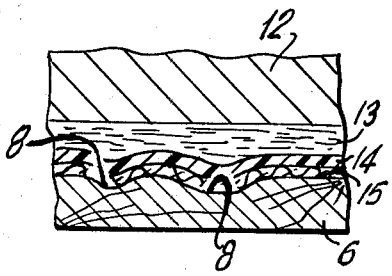
FIG. 4 is an enlarged cross-sectional view of the roll coater of the subject invention taken along lines 4—4 of FIG. 2.

Turning now to the detailed construction of the subject roll coating applicator, and specifically to FIGS. 3 and 4, the applicator 10 of the subject invention includes a central core member 12, and a layer of fibrous, compressible, pliable material disposed around the core. Preferably, the fibrous material is of a web construction that is held together by a binding adhesive. The material may be of a natural fiber or formed from a synthetic material, and can vary in density and in coarseness according to the desired application. The function of web material 13 will be described in more detail below.

Further referring to FIGS. 3 and 4, a very thin, flexible, tube member 14 is disposed over and around the layer of fibrous web material 13. The tube 14 may be any suitable flexible, impervious plastic material such as for example, polyethylene. The final layer of the subject applicator 10 comprises a thin layer of woven material 15, preferably woven sock material which is disposed around tube 14. As is shown in FIGS. 3 and 4, the tube 14 and woven material 15 comprise very thin layers of the subject applicator as compared to the relatively thick layer of fibrous web material 13.

Figure 2:
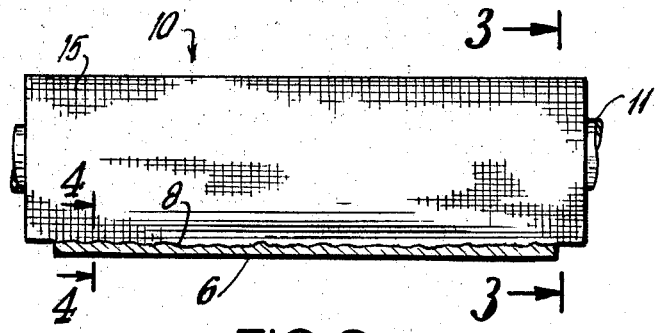
FIG. 2 is a side elevational view, sectioned in part, of the roll coater of the subject invention taken along lines 2—2 of FIG. 1.

Referring now to FIGS. 2 and 4, and especially to the enlarged sectional view illustrated in FIG. 4, it will be noted that the surface 8 of panel 6 which comes in contact with roll applicator 10 is textured and quite irregular. However, in accordance with the subject invention, roll applicator 10 is able to completely and uniformly cover the surface 8 of panel 6 with coating material. Referring to FIG. 4, it will be noted that the relatively thick layer of fibrous web material which is quite soft and pliable, easily takes the form of, and completely covers, the crevices in irregular surface 8. The thin, impervious polyethylene tube member 14 which is disposed around fibrous layer 13 prevents any coating material from penetrating layer 13 and thus, keeps it in its soft, pliable state at all times. Because tube 14 is very thin it does not inhibit the ability of relatively thick layer 13 from assuming the contours of the panel 6. The third layer of the subject applicator 10 is the layer of woven sock material 15 which receives the coating material from rollers 4 and 5 (see FIG. 1), carries the coating material, and applies it to the panels 6. Because woven layer 15 is also quite thin relative to fibrous layer 13, there is no inhibition of fiber 13 from fully assuming the contours of panel 6 so as to completely coat the panel.

In summary, the subject invention provides an improved means for coating textured or uneven panel surfaces. The subject roll coating applicator includes a relatively thick layer of a fibrous web material which permits uniform application of a coating film to a panel due to the softness of the web material and its ability to follow contoured surfaces. The subject applicator also includes a very thin protective covering over the fibrous web layer which prevents the coating material from penetrating the fiber web. Thus, there is no loss of the soft construction of the fiber after periods of use and drying of the applicator. The subject applicator is simple in construction and relatively inexpensive to manufacture, and can be made to fit standard direct roll coaters.

While the preferred embodiment of the subject invention has been described and illustrated, it would be obvious that various changes and modifications can be made therein without departing from the spirit of the invention which should be limited only by the scope of the appended claims.

What is claimed is:

1. An apparatus for continuous direct roll coating of textured panels or sheet-like members comprising in combination: a roll applicator; means for continuously applying coating material to said applicator, and means for continuously bringing the panels into contact with said applicator, said applicator including a central core; a relatively thick layer of soft, fibrous, compressible and pliable material having a web construction held together by a binding adhesive, said fibrous layer being disposed over said core enabling said applicator to follow contoured surfaces; a very thin protective tube member disposed around said layer of fibrous web material to prevent coating material from penetrating said fibrous web material, said tube member being of an impervious material; and a very thin layer of woven fabric material disposed over said protective tube member, said layer of woven fabric material absorbing a coating for application by said applicator, said means for continuously applying coating material to said applicator including a reservoir for containing the coating material, a first roller partially immersed in said reservoir, a second roller immediately adjacent said first roller and engaged therewith, said second roller also being immediately adjacent to and engaged with said applicator, and means for rotating said first and second rollers and said applicator such that said first roller and said applicator rotate in the same direction, and said second roller rotates in the opposite direction to that of said first roller and applicator.

2. An apparatus as recited in claim 1 in which said means for continuously bringing the panels into contact with said applicator comprise a moving conveyor belt.

3. An apparatus as recited in claim 1 in which the layer of fibrous material of said applicator is made from a synthetic material.

4. An apparatus as recited in clim 1 in which the layer of fibrous material of said applicator is made from a natural fiber.

5. An apparatus as recited in claim 1 in which the tube member of said applicator is made from polyethylene.

6. An apparatus as recited in claim 1 in which the layer of woven material of said applicator is made from a woven sock material.

7. An apparatus for continuous direct roll coating of textured panels or sheet-like members comprising in combination: a reservoir for containing the coating material; a first roller partially immersed in said reservoir; a second roller immediately adjacent said first roller and engaged therewith; a roll applicator immediately adjacent said second roller and engaged therewith, said applicator including a central core member, a relatively thick layer of soft, fibrous, compressible and pliable material having a web construction held together by a binding adhesive, said fibrous layer being disposed over said core member enabling said applicator to follow contoured surfaces; a very thin protective polyethylene tube member disposed around said layer of fibrous web material to prevent coating material from penetrating said fibrous web material, and a very thin layer of woven fabric material disposed over said protective member, said layer of woven fabric material absorbing a coating for application by said applicator; means for rotating said first and second rollers and said applicator such that said first roller and said applicator rotate in the same direction, and said second roller rotates in the opposite direction to that of said first roller and said applicator; and movable conveyor means disposed adjacent said applicator for continuously bringing the panels into contact with said applicator.

* * * * *

UNITED STATES PATENT AND TRADEMARK OFFICE

CERTIFICATE OF CORRECTION

PATENT NO. : 4,294,187

DATED : October 13, 1981

INVENTOR(S) : Ozzie Fogle

It is certified that error appears in the above—identified patent and that said Letters Patent is hereby corrected as shown below:

Column 1, after the first paragraph insert the following:

BACKGROUND OF THE INVENTION

The subject invention relates to an apparatus for applying a coating material to textured or unevenly surfaced sheet-like materials, and more particularly, to a paint applicator for direct roll coating of textured panel member such as exterior siding or interior plywood panels having a contoured surface. These panels are generally composed of wood or synthetic material which is intended to simulate a wooden appearance and typically include striations or a plurality of grooves for providing the desired aesthetic effect. In practice, it is desirable that these panels have different colors for matching different home decors, and so the panels must be painted or dye coated. It will be appreciated that the painting or dye coating process must be a

UNITED STATES PATENT AND TRADEMARK OFFICE

CERTIFICATE OF CORRECTION

PATENT NO. : 4,294,187

DATED : October 13, 1981

INVENTOR(S) : Ozzie Fogle

It is certified that error appears in the above—identified patent and that said Letters Patent is hereby corrected as shown below:

continous one for economical reasons and that the method of applying the coating must be such that all the crevices in the striations and grooves are thoroughly covered.

There are several techniques now being used for coating textured or unevenly surfaced wood panels. For example, in one technique the surface of the panel is coated with a knife coater. The panel is then brushed or subjected to an air blast to remove excess paint. This technique has been found to be inefficient, however, because of the loss of paint during the process. Another technique currently used is spray coating the surface of the panel. It will be appreciated

UNITED STATES PATENT AND TRADEMARK OFFICE

CERTIFICATE OF CORRECTION

PATENT NO. : 4,294,187

DATED : October 13, 1981

INVENTOR(S) : Ozzie Fogle

It is certified that error appears in the above—identified patent and that said Letters Patent is hereby corrected as shown below:

that such a process is also inefficient and that there is a substantial loss of paint.

Signed and Sealed this

*Twentieth* Day of *July 1982*

[SEAL]

*Attest:*

GERALD J. MOSSINGHOFF

*Attesting Officer*

*Commissioner of Patents and Trademarks*